United States Patent [19]

Jarach

[11] 4,369,703

[45] Jan. 25, 1983

[54] DEVICES FOR NUMERATION, OVERPRINTING, PERFORATION AND CUTTING ON OFFSET SHEET PRINTING MACHINES

[76] Inventor: Roberto Jarach, via Monte Rosa, 17, 20100 Milano, Italy

[21] Appl. No.: 251,301

[22] Filed: Apr. 6, 1981

[30] Foreign Application Priority Data

May 2, 1980 [IT] Italy ..... 21757 A/80

[51] Int. Cl.[3] ..... B41F 13/14

[52] U.S. Cl. ..... 101/76; 101/216; 101/349

[58] Field of Search ..... 101/216, 349, 212, 232, 101/350, 76–77, 248, 144

[56] References Cited

U.S. PATENT DOCUMENTS

| | | | |
|---|---|---|---|
| 2,892,399 | 6/1959 | Chase | 101/349 |
| 3,678,849 | 7/1972 | Musgrave | 101/349 X |
| 3,814,014 | 6/1974 | Dahlgren | 101/349 X |
| 3,996,856 | 12/1976 | Beisel | 101/349 X |
| 4,024,812 | 5/1977 | Jahn | 101/349 X |
| 4,262,590 | 4/1981 | Bruckner | 101/216 X |
| 4,271,760 | 6/1981 | Lorse | 101/349 |

*Primary Examiner*—E. H. Eickholt

*Attorney, Agent, or Firm*—Bucknam and Archer

[57] ABSTRACT

Improvement in devices for numeration, printing perforation and cutting in Offset sheet printing machines, characterized by the fact all operative structures, including the inking mechanism are combined in a structural unit, shiftable "as a drawer" between the printing machine's shoulders, to the extent necessary for the service of the same device, for performing the functions and respectively for performing the removal to the necessary extent for the service of the machine without the functions and all preparatory operation of the individual operations and of maintenance of the same machine and of the drawer.

The invention comprises also the improved "as a drawer" unit as hereinbelow specified.

12 Claims, 8 Drawing Figures

14
16
18-54
3
3
3
3
20
22
28
30
32
34
36
38
40
42
44
48
58

DEVICES FOR NUMERATION, OVERPRINTING, PERFORATION AND CUTTING ON OFFSET SHEET PRINTING MACHINES

The present invention concerns an improvement in the devices for the numeration, overprinting, perforation and cutting in "Offset" sheet printing machines.

The present invention concerns also the improved device as hereinbelow specified, and in particular the devices which because of special structural and functional association in the machine, in particular between the so-called "shoulders" of the same machine, may be properly defined with the expression "as a drawer", because the device is slidingly supported as a drawer, between the shoulders, in an Offset machine in general for the printing of small and also of medium and large format.

These printing machines are well known in the art and do not require detailed comments, except these hereinbelow described and specifically concerned with the invention.

The provision of devices for the numeration, the overprinting, the perforation and the cutting of the sheets, during and after the regular monocolor or multicolor printing on printing machines of the above type, is of relevant importance.

As a matter of fact, these operations, which are complementary to the very printing, are for example required in the occurrence of sequential numeration of different documents, for example current account cheques, travel documents (such as tramway tickets, theatre tickets, sport meeting tickets and the like), documents which inter alia provide the proof of tax obligations and are required in the preparation of other equivalent documentations, on printed forms.

The device according to the invention, may be extended to any field of use and to the industrial products, specifically printing machines, which must meet to equivalent requirements.

The different Offset sheet printing machines, including means for sequentially performing the numeration, the overprinting, the perforation and the cutting of sheets or fractional sheets, may be classified in the following three types:

Type 1-by providing for the approaching, the engaging and the securing to the properly arranged printing machine, of a numerating unit, adapted to perform other functions;

Type 2-by means of a numerator bearing shaft being clutched between the printing machine shoulders, properly arranged, which may be drawn out and which may be connected in releasable manner with the supporting and controlling members secured in stationary manner in the machine frame, and an inking subassembly, which in turn is adapted to be drawn out and which is connected in releasable manner to supporting and controlling members, arranged in a stationary manner in the frame of the same machine;

Type 3-by means of an operative subassembly getting into, and being clutched also between the printing machine shoulders, the machine being also suitably arranged, when necessary, also, provided with inking groups, secured to one of the two the machine's shoulders, in such manner that it may be rotated about a vertical axis consisting of a shaft or a shaft portion or pivotal components arranged in a stationary position of the machine on one of the two shoulders.

Machines falling within the second one of the above types, and which are most pertinent with the invention, have been described and illustrated in the patent application No. P 22 21 343 of the German Federal Republic.

Briefly reconsidering the prior art, it can be assumed that the first one of this three types of devices, associated to an Offset printing machine, has the drawback that it requires substantial space for applying to the machine the operative subassembly and for its storage when the same device is not in operation, and also, because it requires rather complicated operations for its transportation, detaching from or assembling to the machine.

The second type requires, in addition to the availability of space for the storage of the numerator bearing shafts and of the inking systems when it is not in operation, the availability also of a work-bench and of equipped stands for the preparation and the performance of the individual operations and for the storage of the individual components or component groups removed from the machine.

This second type is also subject to the objection of its adaptation to small formats, because of the weight and of the overall dimensions of the components or component groups to be handled when the work to be modified.

In the third type of these devices, at last, the overhanging supported weights, which are arranged upon hinge means on one only of the machine's shoulders, when the regular printing at highest speed is performed, may negatively and harmfully influence the quality and the precision of the print, in addition to limiting the use to small formats.

Therefore, it is an object of the invention to provide a device for the numeration, printing, perforation, and cutting of sheets in an Offset sheet printing machine, for printing on one or several colors, and also of medium or large format. The improved device permits the alternate use of the machine for regular printing one or several colors or respectively as a "printing—numerating—perforating—cutting" machine, without being subject to the objections which are typical of the already known systems, and without requiring the carrying, externally to the printing machine, of components or groups of components of the device, capable of performing the numeration and the other operations indicated above, and of the inking device, by means of operations which are simple, and safedly performable by one person, in particular by one typographer employed to the machine.

Substantially, the "as a drawer" device, according to the invention, comprises a numerating group—overprinting group—perforating group—cutting group, as well as an inking group, jointly forming an assembly which is permanently arranged on the printing machine, and more particularly between the structural shoulders of the machine, also when the same mahine is used for performing regular printing operation, the preparation of the work and the usual maintenance of the machine.

According to another feature of the invention, the improvement is characterized by the fact that all principal and complemetary movements of the components comprised in the "drawer" are operated and driven by one gear wheel, which is connected to same drawer, and which is driven by an intermediate gear wheel, coupled to the "printing cylinder" of the same machine.

According to a further feature of the improvement, the improved device is characterized by the fact that meshing between the teeth of the driving gear wheel of the group (comprised in the same drawer) and the teeth of the intermediate gear wheel which drives the group (which is coupled to the gear wheel of the printing cylinder, is provided and arranged in such manner that the same meshing may occur only when the shaft which bears the numeration, perforation, and all other functions is phased with the printing cylinder.

These and other more specific features of the invention will be evident during the following detailed description, referred to the accompanying drawings.

The improvement allows to carry out on an industrial scale and combine to the printing machine a numerating overprinting, perforating and cutting subassembly which comprises all means required for its service, including the inking of the numerating and overprinting means, the subassembly being:

(i) simple and compact;

(ii) permanently arranged between the printing machine's shoulders also when the machine is used as a regular Offset printing machine, and when the preparation of the work is performed;

(iii) shiftable as a drawer on guide means secured in the interior of the shoulders of the same printing machine, and (iv) disassociable for the regular printing, for the preparation of the printing with numerating and so on, and for the cleaning and the maintenance of the same subassembly and for the same printing machine, by means of simple shifting of the "drawer".

Therefore, by operating according to the invention, (v) when the machine is used as a conventional printing machine, or the preparation of a new work is desired to be performed, or cleaning or regular maintenance operations are to be made, it is sufficient upon stopping of the machine, to shift the drawer in its "disengaged" position (this position being preferably defined by the lighting of a warning light, green for example) and which corresponds to that of the complete retraction of the drawer to the end of stroke, this position ensuring (a)-the inactivation of the numerating etc. subassembly, (b)-the accessibility of the printing machine's components, and of these of the same subassembly or group, in particular of the "rubber" and "printing" cylinders, and of the components related to the outlet of the printed sheets;

(iv)-when on the contrary the performing of the typical numeration, overprinting etc. operation are to be performed, upon stopping of the machine and having provided to the phasing of the actuating means of the very gravers with the actuating of the machine, it is sufficient to shift the drawer in the "on" position (this position being preferably defined by the lighting of a for example red warning light).

In the embodiment described below and illustrated in the accompanying drawing, a machine in particular for "not large" formats will be described, and at least in part will not be discribed in detail. The several servo control self-acting, electronic synchronization means, as well as the several electrical, pneumatic, hydraulic, hydropneumatic, electronic and the like motorizations, which are encompassed by the known art related to the large format sheet printing machines, and to which the invention will not be described.

In the enclosed drawing

FIG. 1 diagrammatically illustrates as a whole and in small scale, as well as in side view, a medium format single color sheet Offset printing machine, to which an improved as a drawer device according to the invention, is structurally and operatively associated;

Figure 6:
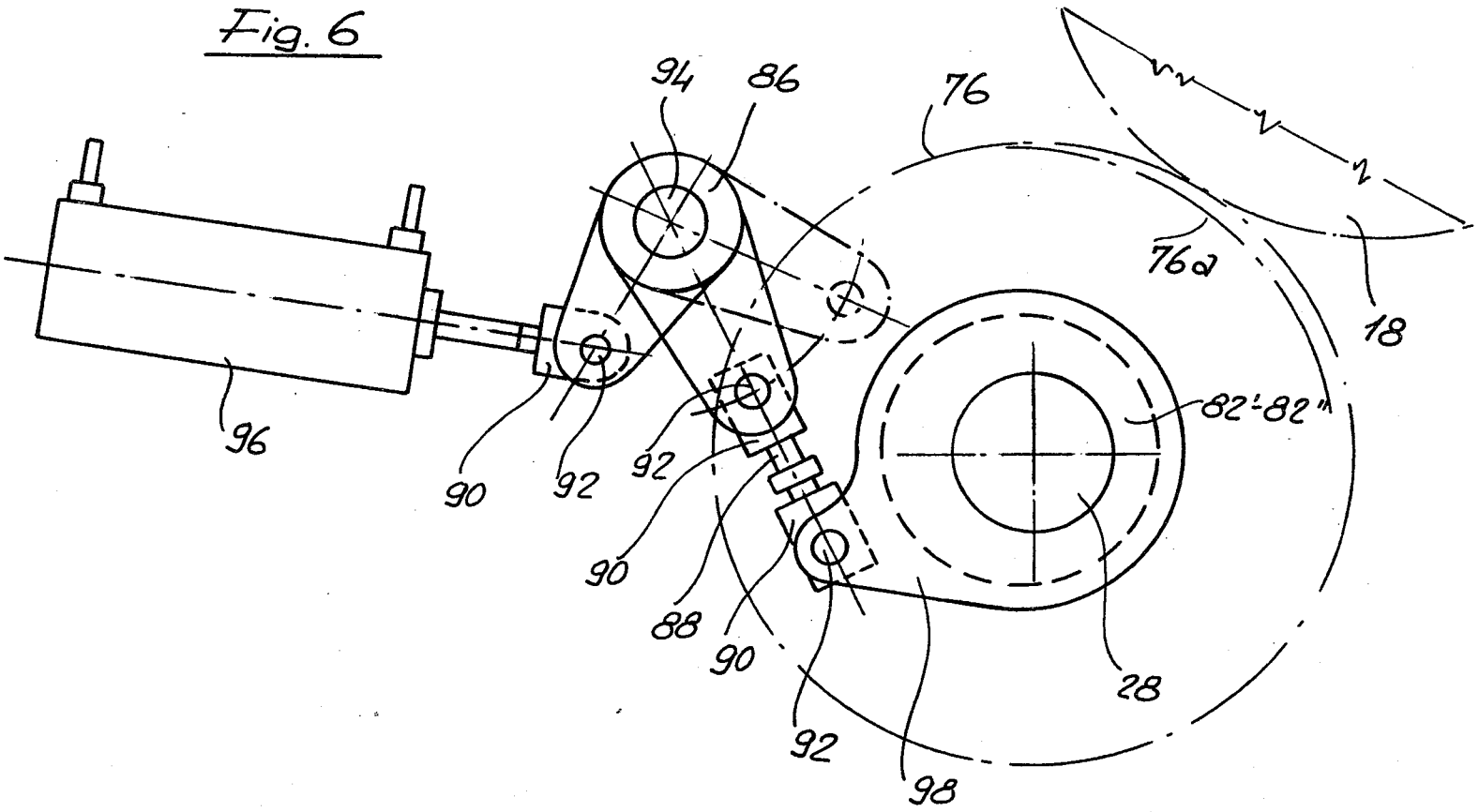
Figure 7:
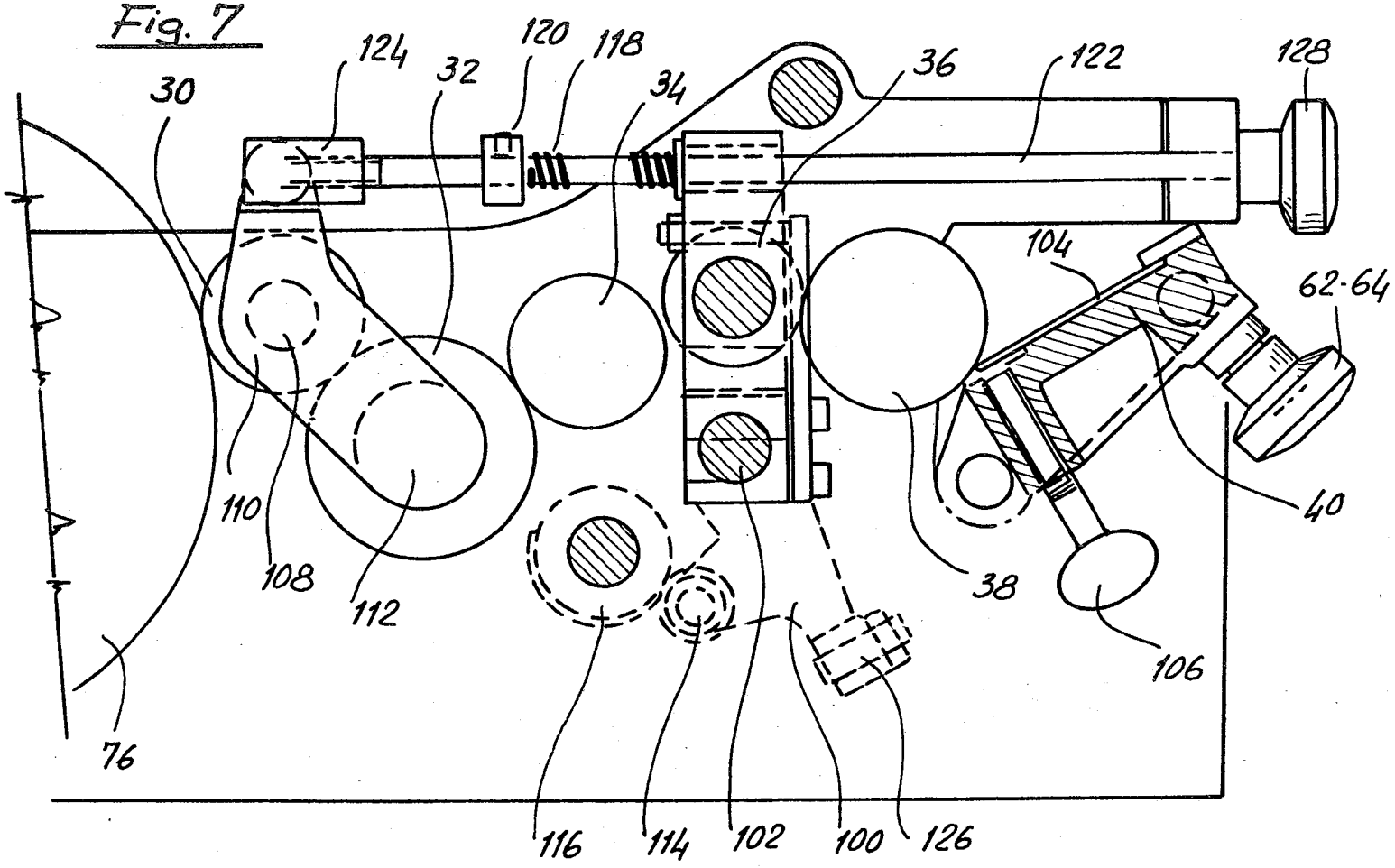

FIG. 6 illustrates details of the device and of the means for urging and for releasing the pressure condition of the numerating means and of the other characteristic mechanisms which are necessary for embodying the invention, during the printing with numeration, and FIG. 7 illustrates in elevational and sectional view, the subassembly including the inking of the numerating, overprinting and the means related to the invention and requiring the inking.

Figure 1:
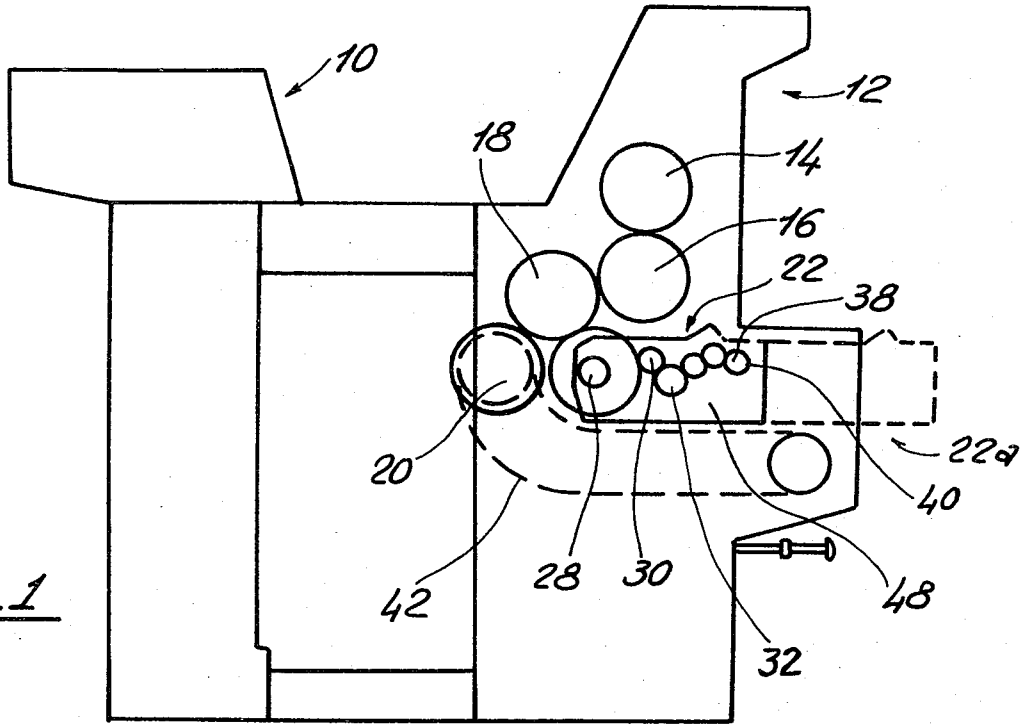

More particularly referring to the figures of the drawing:

as a whole illustrated in FIG. 1, an Offset printing machine to which drawer improved device is associated, comprises a "feeder" subassembly 10 and (in the example) an individual printing unit 12, a plate cylinder 14, a rubber cylinder 16, a printing cylinder 18, a shaft 20 for the delivery of the sheets, the other components and elements typical of and known in the printing machines of the type considered, being omitted for simplicity sake.

Below the printing cylinder 18 and aside the sheet delivery shaft 20, the drawer device is arranged, and generally indicated at 22 in its "on" position and at **22*a*** (by a dot-outline) in its "disconnected or off" position.

Figure 3:
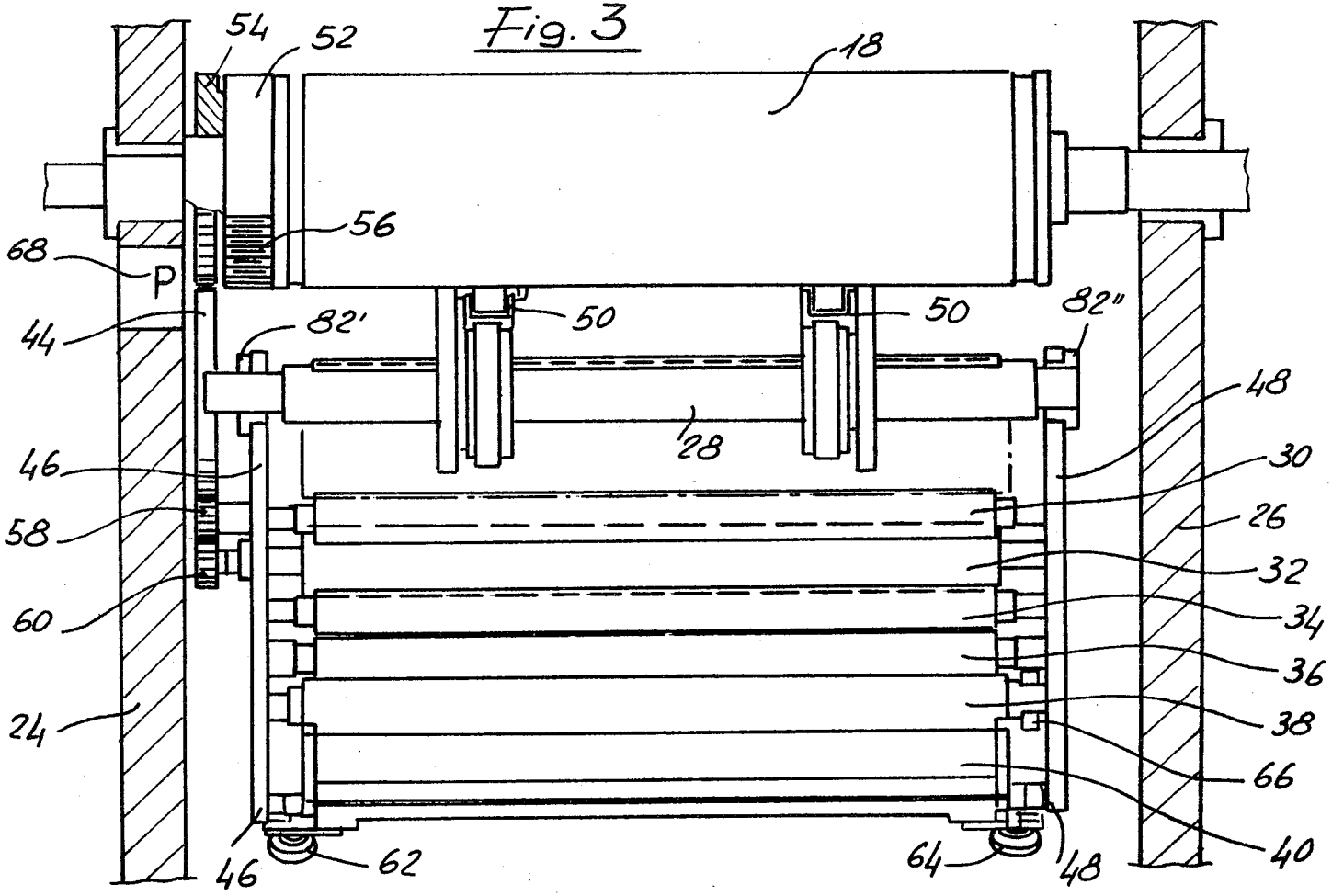
FIG. 3 illustrates, in view from above and in the directions and sectional planes indicated at 3-3-3-3 in FIG. 2, the shoulders of the machine, the printing cylinder and the drawer including its principal elements, as well as the exterior and interior elements which control the same drawer, in the said position of drawer "on"

This drawer slides on suitably shaped guide means (not illustrated in the drawing) between the very shoulders 24 and 26 of the machine (see, for example, FIG. 3).

Figure 2:
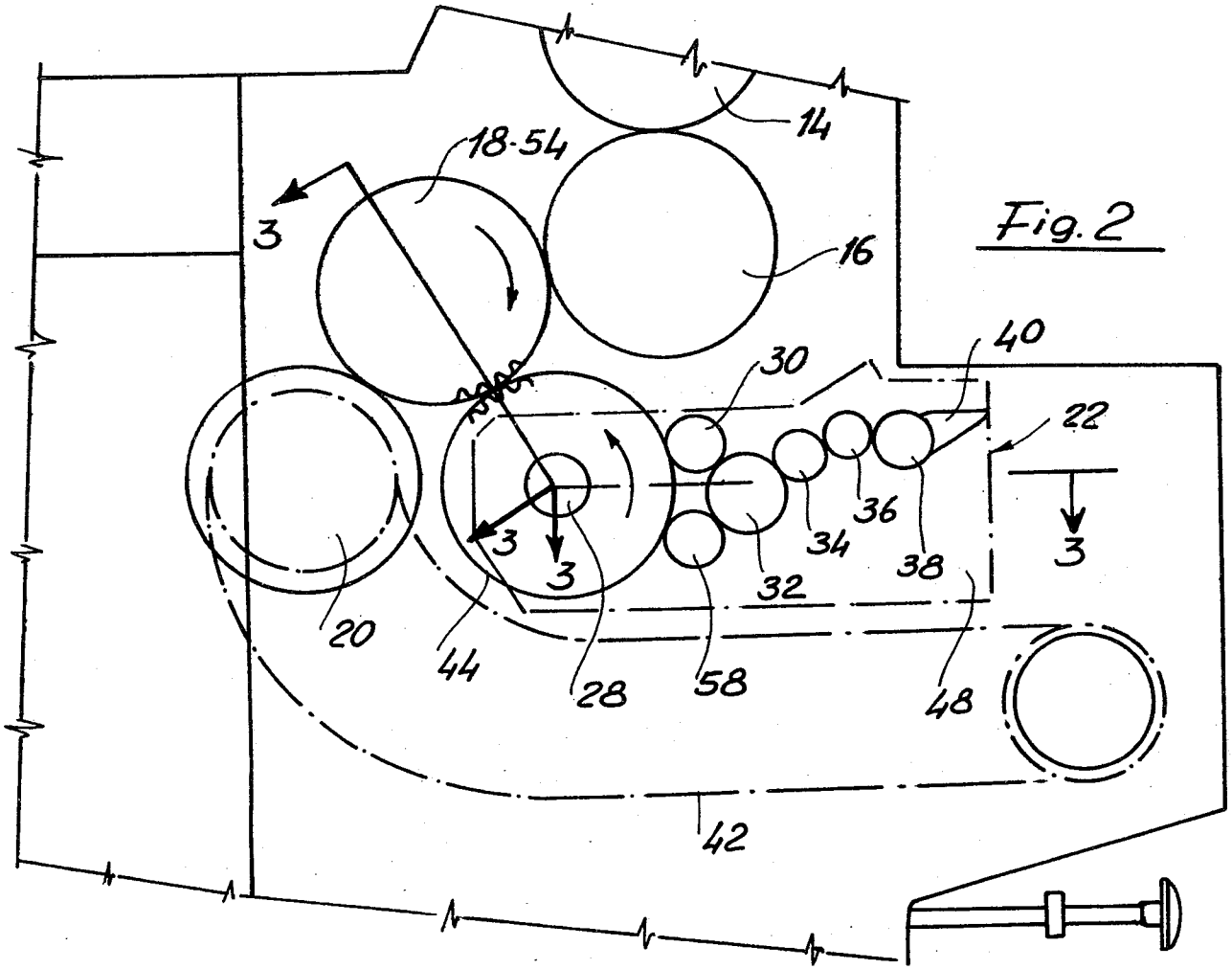
FIG. 2 illustrates, in side view and in larger scale and detail, the components which control the drawer, and the elements located in the interior of the drawer, in the position corresponding to "drawer on"

In the space circumscribed within said drawer, there are arranged the numerating means bearing shaft 28, the inking roller 30, the milling roller 32, and the various rollers which cooperate with the inking of the numerating means, that is the intermediate roller 34, the transfer roller 36, the ink fountain duct roller 38, and the very ink fountain 40, these components and their actuations being seen best in FIG. 2.

Practically, in the embodiment shown in the drawings, the drawer is partially circumscribed by chain 42 which carries the printed sheets to the outlet. The numerating means bearing shaft 28, and more precisely the numerating means (see below) cooperate in a known manner with the printing cylinder 18.

The actuators for the drawer are at least partially illustrated in FIGS. 2 and 3. All operative components included in the drawer are actuated by a sole gear wheel 44, which is connected to the same drawer, and which is supported, outside its own small shoulders 46 and 48, the outline only of which is illustrated in FIGS. 1 and 2 on the numerating means bearing shaft 28.

In FIG. 3 there are also fragmentarily indicated at 50 the numerating, perforating etc. devices, and in the same FIG. 3 there is also illustrated the printing cylinder 18 and its related gear wheel 52. The latter is coaxial with and angularly associated to a gear wheel 54 which meshes at 56 with a gear wheel 44. The latter actuates the devices comprised in the same drawer, and in its turn drives the intermediate gear wheel 58 for the actuation of the inking arrangement, and the gear wheel 60 arranged on the main milling component 32 of same inking arrangement. In FIG. 3 there are also seen the transfer roller 36, the intermediate roller 34, the fountain duct roller 38 and the ink fountain 40, having securing screws 62, 64.

The drive is indirectly transmitted to the fountain duct roller 38, by means of a ratchet gear 66 (diagrammatically indicated in FIG. 3).

The remaining above described rollers of the inking arrangement (transfer, intermediate and inking rollers) are rotatarily frictionally driven by the rollers which are driven by the above indicated gear wheels.

The details of the actuation of the individual rollers of the inking arrangement of the numerating means can be understood by the drawings and their specific description can therefore be omitted.

For operation of the gears 44 (which actuates the drawer and 54 associated to the gear 52 of the printing cylinder 18, a phase control is made, for example by controlling the indexing of pointers which can be seen through an inspection passage 68 provided in the shoulder 24 of the machine (FIG. 3).

Figure 4:
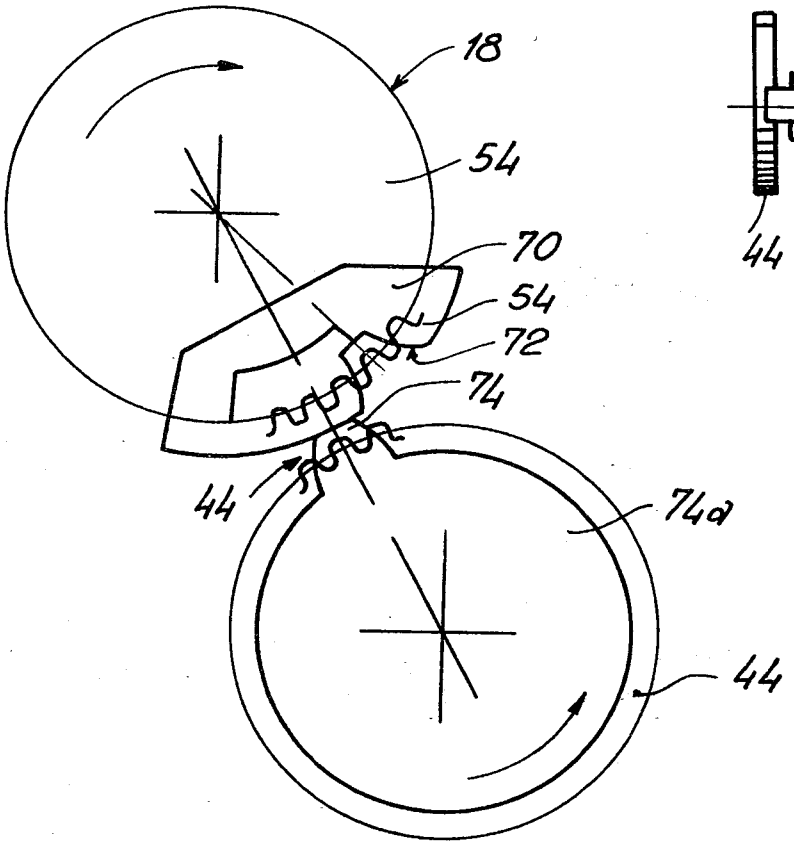
FIG. 4 illustrates the means connected to the device, for phasing of the actuation of the drawer with the actuation of the machine.

The device or more generally the means provided for preventing the drawer being clutched relatively to the machine, are shown best in FIG. 4, wherein said means are fragmentarily illustrated and evidenced.

The gear 54 comprises a sector 70 having an individual female tooth 72, while the gear 44 (fragmentarily illustrated also) bears a congruent link embodied by an unitary tooth 74, borne by a disk **74*a* and arranged for meshing with the female tooth 72 of sector 70**.

The outside of sector 70 and/or of disk **74*a* comprising the one male tooth 74 are machined at a diameter which is some millimeters lower than the shallow recess of the gears 44 and 54. The module of the unitary tooth 74 and the congruent link compoent (the female tooth 72) is at least twice that of the gearing of said gears 44 and 54**.

Figure 5:
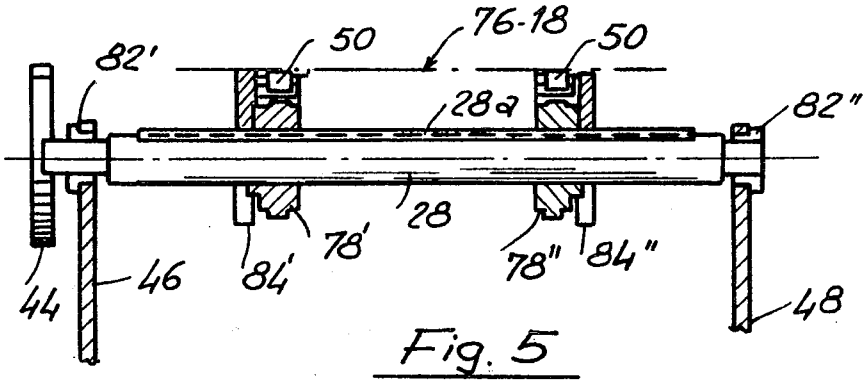
FIG. 5 illustrates in sectional view and in diagrammatical manner, the "small shoulders" of the drawer, and the shaft which bears the numerating and the other mechanisms which are characteristic of the device.
Figure 5A:
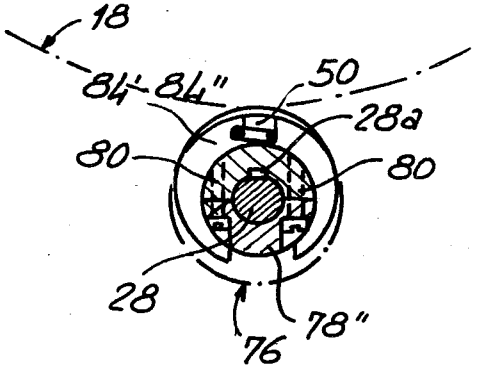
FIG. 5A is a sectional and elevational view of the detail of the device of FIG. 5.

The operating subassembly of the drawer is illustrated in more detail partially in elevational view and partially in sectional view in FIGS. 5 and 5A. The dot-and-dash line 76-18 indicates the trace of the printing cylinder (and therefore the sheet being printed) on which the numerating means 50 and the other devices operate, and the path of the same.

On the numerating means bearing shaft 28 there are keyed at **28*a*, supports 78 (which are in turn numerating means bearing) consisting of two counterposed components 78' and 78'', secured for example by means of bolts 80. This shaft 28 is arranged on the small shoulders 46 and 48 of the drawer, by means of eccentric bushes 82' and 82'', so that the operations of driving near and of driving far can be made, and therefore the urging of numerating means and viceversa. Upon supports 78' and 78 there are secured eccentric disks 84' and 84''**, of horseshoe configuration, which concurrently pressurize the sheet on the printing cylinder, upon being urged by the numerating and of the other operation carried out by the same drawer.

As illustrated in FIG. 6, the device provided for applying and removing the pressure upon the numerating means and the other operative mechanisms which are associated to the drawer, actuates the numerating means bearing shaft 28. The circle 76, indicated in dot-and-dash, corresponds to the that of the numerating means when in operation, and its arc **76*a*, which is eccentric relatively to said circle 76**, defines the path of the numerating means (and of the devices associated thereto) in the "no pressure" condition.

An arrangement including levers tie rods, articulations and pivots 86, 88, 90 and respectively 92, arranged for rotation about a pivot 94, secured on the small shoulders of the drawer, and a cylinder, preferably a pneumatic cylinder 96, automatically operates when the feeding of the sheet to printing cylinder is missing, and, upon a manual actuation, when it is considered necessary by the operator. The components promote the rotation of eccentric bushes 82' and 82'' provided with a short lever 98, with subsequent alternative pressurization and respectively depressurization of the numerating means and other devices, arranging them in the position indicated at **76*a***.

The subassembly including the numerating means inking arrangement and possibly other devices which require the inking and which are comprised in the drawer, is detailedly illustrated in FIG. 7, in which at least partially appears the path 76 of the numerating means about the related numerating means bearing shaft, path which is tangent to printing cylinders, when the numerating means are in their operative overprinting condition.

The main inking roller 30 cooperates with the main milling roller 32 which in turn cooperates with the adjacent intermediate roller 34. The roller 36, which acts as a transfer roller, is supported by a lever 100 which oscillates about a pivot 102 and is alternatively approached against the fountain duct roller 38. The latter is rotated in the ink fountain 40, provided with a known doctoring and metering blade 104, which is adjustable by acting on set screws 106.

The inking roller 30 is supported, by means of an eccentric pivot 108, by a lever 110 oscillatable about an axis 112, coincident which the axis of the milling roller 32.

The fountain duct roller 38 is actuated by means of a ratchet gear 66 (which has been indicated above and diagrammatically shown at 66 in FIG. 3) and the oscillating lever 100, actuated, by means of the small roller 114 supported by same lever, by an actuating cam 116, integrating the alternative forwardly and rearwardly arrangement of said means, for performing the inking, when in phase concurrently with the other movements.

The device is also provided with means for adjusting the inking. This adjustment is made by means of the set screws 106, which operate on the blade 104 of the ink fountain 40.

A return spring 118 abutting on an adjustment bush 120, provides for obtaining a controlled action between the small roller 114 and the cam 116.

A rod 122, which screwingly engages with a small block 124 (which cooperates as an articulation with the end of lever 110) provides for defining the position of the lever 110 of the inking roller 30, with consequent adjustment of the pressure of the said inking roller 30 on the numerating means. A screw 126 arranged upon the oscillating lever 100, is comprised in the device which discontinues the operation of the transfer roller.

By acting upon the bush 120, the load of the spring 118 can be adjusted. By taking advantage of the eccentricity of the pivot of the inking roller 30 (eccentricity which is indicated by approached crosses within the outline of pivot 108) the parallelism between the inking roller and the axis of the path 76 of the numerating means can be improved.

It is evident that the invention may be carried out and industrially utilized when associated to an Offset printing machine of different dimensions and including modification without departing from the scope of the same invention which is defined in the accompanying claims.

I claim:

1. In a sheet-fed offset machine, having a stationary machine frame having shoulders (24, 26), a sheet feeder (10), which delivers sheets to a printing cylinder (18), said printing cylinder cooperating with a rubber cylinder and a plate cylinder (14), an inking mechanism, for the numeration device, perforation device and cutting device, a sheet delivery outlet (20), gear wheels for actuating the printing cylinder, the numeration device, and the inking mechanism, the improvement which comprises a subassembly slidable as a drawer (22) between said shoulders of the machine and arranged on the side of the sheet delivery outlet, said subassembly including the numeration device which comprises shaft (28), the inking roller (30), milling roller (32), intermediate roller (34), transfer roller (36) ink fountain (40), said numeration device being engageable with the printing cylinder (18), the perforation device, and the cutting device, a first gear wheel (44) for actuating the components of the drawer subassembly, which first gear wheel is supported by said shaft (28) and is actuated by a second gear wheel (54) coupled to the third gear wheel (52) of said printing cylinder.

2. The machine according to claim 1, wherein said gear wheel (52) of the printing cylinder (18) is coaxial with said second gear wheel (54), which meshes with said first gear wheel (44) only when the numeration device shaft (28) is in phase with said printing cylinder (18).

3. The machine according to claim 2, wherein the inking mechanism is actuated by an intermediate gear wheel (58) and said first gear wheel (44) drives said intermediate gear wheel (58).

4. The machine according to claim 2, wherein the drawer is shiftably arranged on supporting means (78',78'') secured in the interior of the structural shoulders of the machine to said shaft (28).

5. The machine according to claim 1, wherein said drawer subassembly comprises its own inking system.

6. The machine according to claim 1, which is provided with phase clutching means for connecting the components of the drawer subassembly in phase, and the operative components of the machine, which means comprise a sector (70) on said second gear wheel (54), said sector having a female tooth (72) and said first gear wheel (44) is provided with a sole male tooth (74) for meshing with said female tooth.

7. The machine according to claim 1, wherein the drawer subassembly is a drawer provided with shoulders (46,48) and the numerating means (50) and their bearing shaft (28) are arranged upon said shoulders of the drawer, by means of eccentric bushes (82' and 82'') which are rotatably arranged for obtaining, upon attainment of the phase position, the approaching of said numerating means and other complementary devices which appertain to the drawer, to the sheet designed to be overprinted.

8. The machine according to claim 7 wherein said shaft (28) comprises eccentric disks (84' and 84'') for ensuring in the phase position, the pressurization of the sheet against the printing cylinder.

9. The device according to claim 8 which comprises a pneumatic cylinder (96) for effecting the movements required for attaining the pressurization of the sheet against the printing cylinder.

10. The machine according to claim 1, which comprises an inking roller (30), a transfer roller (36), an ink fountain (40), and a fountain duct roller (38) and the machine is provided with cam means (116) for performing the intermittent performance of the transfer of the ink from the ink fountain to the inking roller.

11. The machine according to claim 10 which comprises ink adjusting means, consisting of set screws (106), for discontinuing the action of the transfer roller of the inking system.

12. The machine according to claim 11, wherein the inking roller (30) is supported, in adjustable manner, by means of an eccentric pivot (106) on adjustable arms (110) by means of a lever which oscillates about axis (112) and the machine is provided with means for defining the position of the lever (110) for adjusting the pressure of the inking roller (30) on the numerating means.

* * * * *